United States Patent [19]

Spellman

[11] 4,095,830

[45] Jun. 20, 1978

[54] CONTAINER AND COVER TIE DOWN APPARATUS

[76] Inventor: Michael P. Spellman, 9943 Wentworth Ave., Bloomington, Minn. 55420

[21] Appl. No.: 757,595

[22] Filed: Jan. 7, 1977

Related U.S. Application Data

[63] Continuation-in-part of Ser. No. 679,665, Apr. 23, 1976, Pat. No. 4,009,897.

[51] Int. Cl.[2] ..... E05C 19/18

[52] U.S. Cl. ..... 292/288; 292/259 R

[58] Field of Search ..... 292/258, 288, 25, DIG. 11; 220/85 CH, 1 T, 85 H, 85 CH

[56] References Cited

U.S. PATENT DOCUMENTS

| | | | |
|---|---|---|---|
| 2,977,145 | 3/1961 | Rifkin | 292/321 |
| 4,009,897 | 3/1977 | Spellman | 292/258 |

*Primary Examiner*—Richard E. Moore

[57] ABSTRACT

An integrally formed hold down device for securing the cover of a container which also maintains the container itself in upright position, comprising a resilient one-piece tension strap having three strap extension portions terminating in three looped portions for attachment, two to the side handles of the container and the third loop and its extension portion over the cover for securing the container and cover to a member, such as fence post or wall, or alternately for serving as a handle.

4 Claims, 6 Drawing Figures

CONTAINER AND COVER TIE DOWN APPARATUS

BACKGROUND OF THE INVENTION

This is a continuation-in-part of U.S. Pat. application Ser. No. 679,665, filed Apr. 23, 1976, now Pat. No. 4,009,897, issued March 1, 1977.

The problems of animals removing lids from garbage cans in their search for food, knocking over the cans, and the ensuing mess of strewn refuse, unsightly, attracting rat infestations and making needless work, is well known. Strong winds often topple garbage cans and with the same undesirable results.

Tension straps to retain the lids on the cans are well known. For example, Remig U.S. Pat. No. 3,363,924 discloses the use of flat endless rubber bands, knotted about the lid handle and secured to the side can handles by metal hooks. Williams U.S. Pat. No. 3,589,760 discloses a garbage can clamp having a tension cord of nylon secured as by a turnbuckle to a steel coil spring and associated with metal hooks to engage the side handles of the can. Kolman U.S. Pat. No. 3,174,787 discloses an integrally molded tension strap about ¼inches in diameter having protuberances adapted to be used with a hook member to secure garbage can lids. The present invention eschews the use of accessory members such as metal hooks and accomplishes its two-fold task of lid hold down and can positioner with a single integrally formed tension strap.

SUMMARY OF THE INVENTION

It is the purpose of this invention to provide a cover hold down and a container positioner or strap holder without ancillary parts —no metal hooks, springs or the like, but a strong integrally formed member which is simple in design and inexpensive to manufacture, which can be secured and released with one hand, is long lasting and made of weatherproof material.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
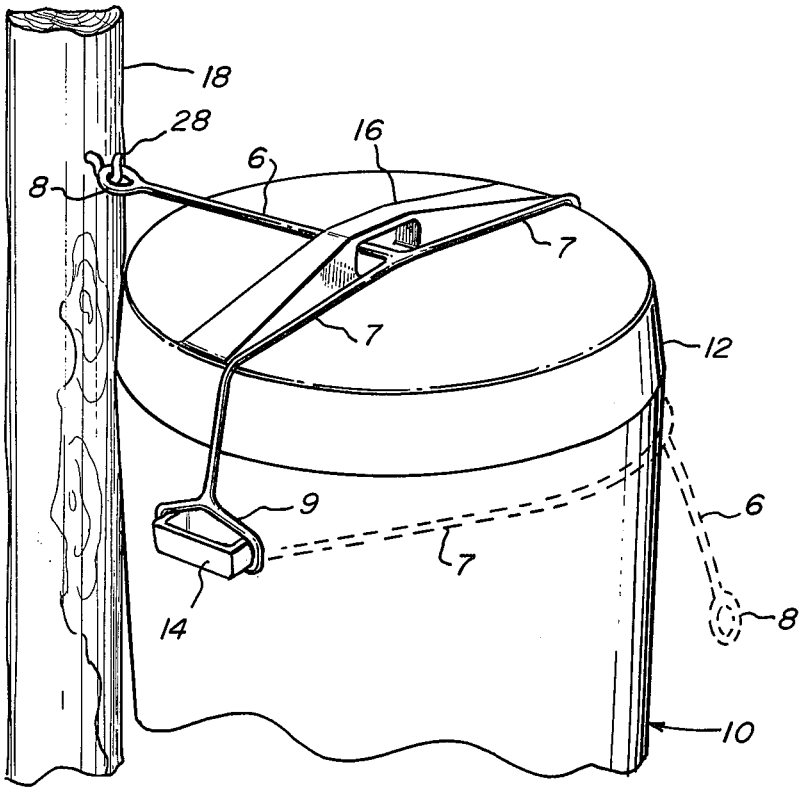
FIG. 1 is a perspective view of the lid and can retainer in use.
Figure 3:
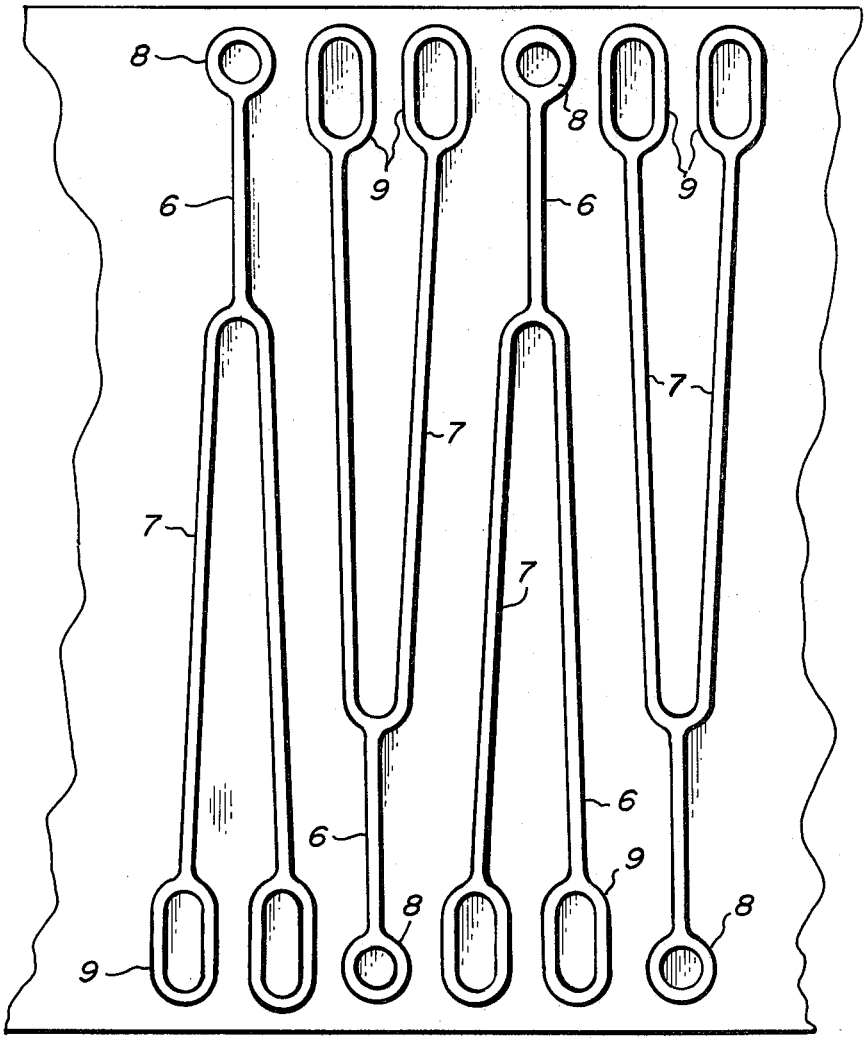
FIG. 3 is a layout of the hold down as manufactured.
Figure 4:
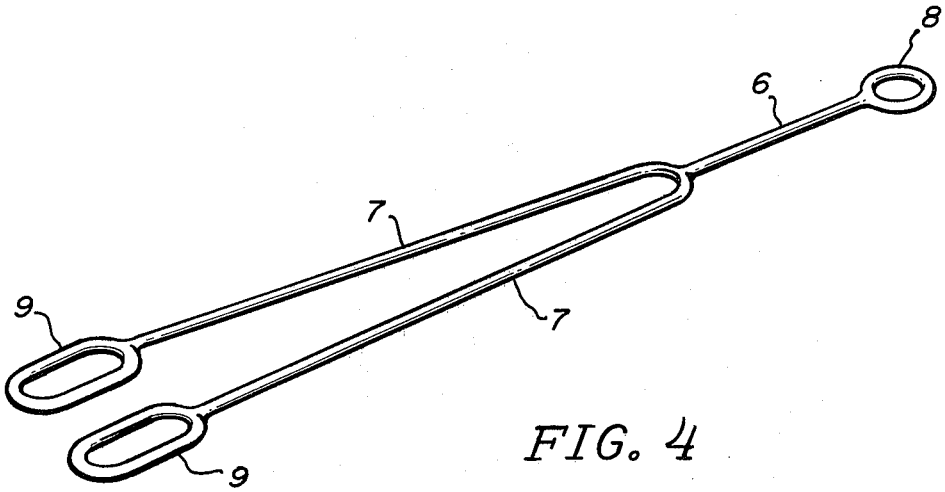
FIG. 4 is a view of the hold down in relaxed position.

Like reference characters indicate like parts throughout the figures of the drawings. Numeral 10 indicates generally a container having a removable cover 12, side handles 14 and a top cover handle 16. In FIG. 1, post 18 having a hook 28 is shown. The hold down is indicated as 5 and shown in its relaxed position in FIG. 4 and FIG. 6, comprises a resilient strap member which may be integrally molded of a water-proof elastic material in a multiple mold, as indicated in FIG. 3, which uses an alternate placement pattern for the most efficient use of space. It could also be stamped out from sheet material in a similar alternate pattern to conserve material.

Figure 2:
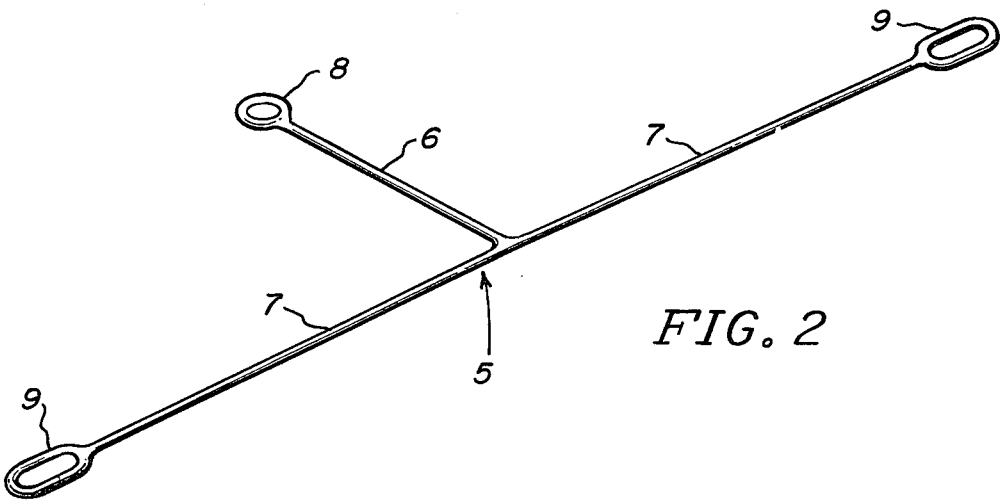
FIG. 2 is a view of the device in its extended position.

Referring to FIG. 2, the hold down apparatus 5 comprises a loop 8 of approximately 1 inch in diameter having a main stem or body portion 6 which is approximately 8¾ inches long and which bifurcates for form two legs 7, 7 approximately 11⅜ inches long, each terminating in a loop 9 having a major axis about 1⅜ inches long and a minor axis about 1 inch wide. The bifurcation and junctures of all stems, legs and loops are curved so that no weak edge is presented which is susceptible to tearing and wearing. The cross-sectional diameter of the molded strap material is approximately ¼ inch.

The tie down apparatus may be applied to a 20 gallon capacity garbage can as well as a 30 gallon can. Every portion of the hold down is capable of extension ranging from 20% to 40% over its original length.

Figure 5:
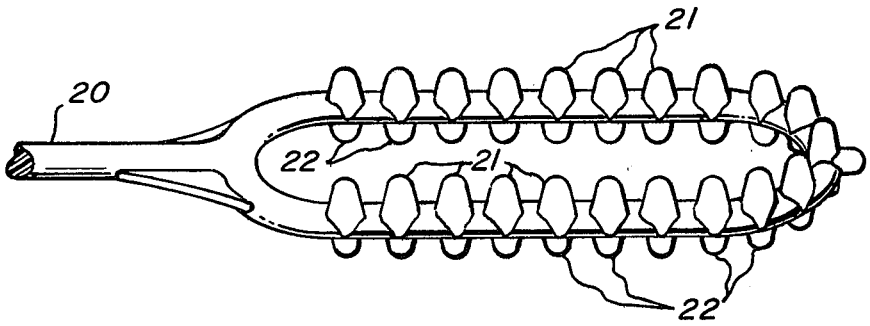
FIG. 5 is a perspective view of an improved loop for securing against a handle.

FIG. 5 shows an improved end loop in perspective view extending from a leg 20. A plurality of raised bosses 21 are arranged around the top face of the loop and a plurality of raised bosses 22 are arranged around the bottom face of the loop. Bosses 21 and 22 may be either oppositely arranged or staggered so as to form alternating bosses around both faces of the loop. Bosses 21 and 22 serve as spacers between the container and the loop to prevent sharp edges along the container surface, particularly in the region around the container handle, from cutting into the loop material. They further provide a means for preventing the respective loops from turning and twisting when the apparatus is removed and replaced over the container cover. Without bosses 21 and 22, it was found that when body portion 6 was stretched to either remove the apparatus from holding down cover 12 or to replace the apparatus over cover 12, that loops 9 tended to turn and twist about handles 14. This sometimes caused loops 9 to slip off a handle 14, or to cause loops 9 to become abraided or cut by any sharp edge which might be in the vicinity of handle 14. Bosses 21 and 22 provide a traction mechanism which successfully resists any such twisting or turning motion of the loops, but they should be raised to a height of at least about ¼ inch to be effective.

Figure 6:
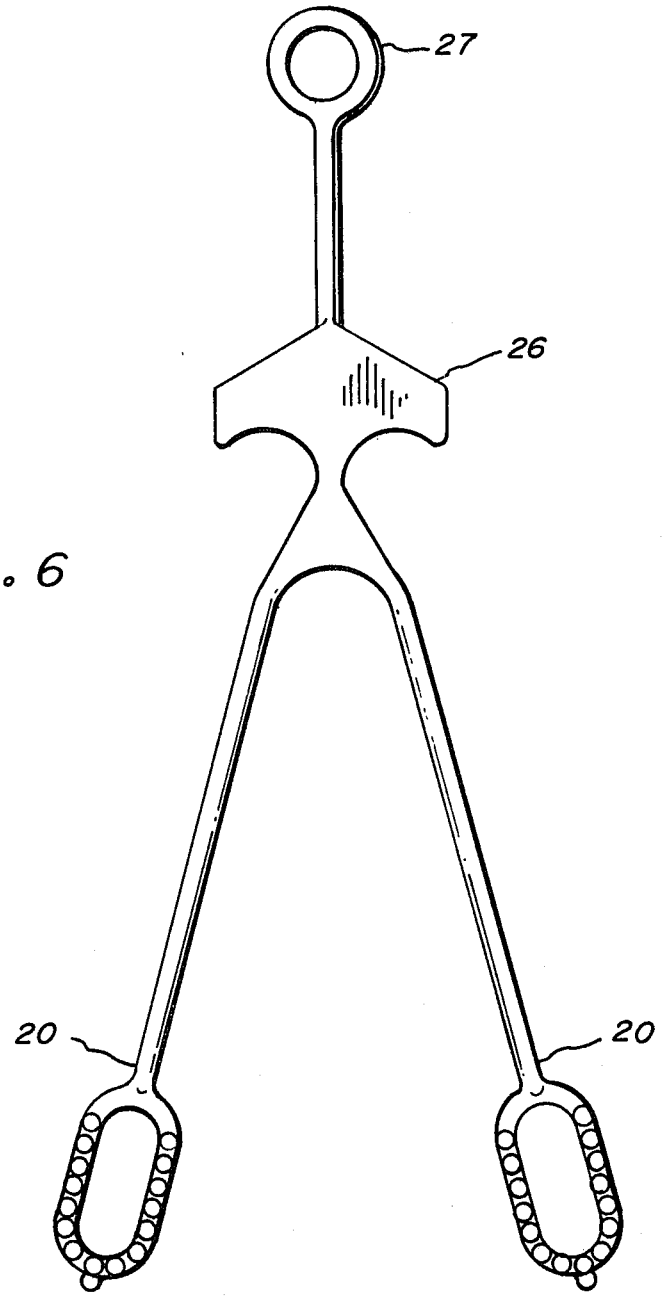
FIG. 6 is a layout of an improved hold down apparatus.

FIG. 6 shows an improved apparatus having the loops of FIG. 5 attached to legs 20, and further having an improved handle 26 formed along the body portion between loop 27 and legs 20. Handle 27 provides a convenient grasping point for stretching legs 20 to enable either the removal or replacement of the apparatus with respect to a container cover. Handle 27 is preferably formed in the same molding process as the remaining portions of the apparatus.

In operation, the resilient hold down strap 5 is extended across the width of the container cover 12, as shown in FIG. 1, with the loops stretched around the side handles 14 of the container to hold the cover down. The stem portion 6 is then run through the top handle 16 of the cover, or merely over the top of the cover, and loop 8 or 27 engages a hook, such as 28 in FIG. 1, to prevent overthrow of the can. The handle 26 may be used to stretch the legs of the apparatus to properly fit over the cover. To remove the cover hold down, hook 8 is disengaged and the handle 27 is pulled over the edge of the container, which can be achieved with one hand. The apparatus as shown in FIG. 1 constitutes a three point hold down arrangement.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be restored to, falling within the scope of the invention.

What is claimed is:

1. A container cover and hold down apparatus formed from resilient tensioning material, comprising:

(a) a first leg having a looped end;

(b) second and third legs having looped ends, each looped end having a plurality of raised bosses arranged at spaced intervals, said second and third leg looped ends adapted for encircling container handles; and (c) a handle on said first leg between said first leg looped end and said second and third legs.

2. The apparatus of claim 1, wherein said handle and said first, second, and third legs are formed from a single molded piece.

3. The apparatus of claim 2, wherein said looped ends of said second and third legs are elongated along the direction of said legs.

4. The apparatus of claim 3 wherein each of said raised bosses is at least $\frac{1}{4}$ inch in height.

* * * * *